United States Patent [19]

Johnson

[11] 4,064,412

[45] Dec. 20, 1977

[54] CATHODE RAY TUBE BASE

[75] Inventor: Alfred D. Johnson, Seneca Falls, N.Y.

[73] Assignee: GTE Sylvania Incorporated, Stamford, Conn.

[21] Appl. No.: 702,095

[22] Filed: July 2, 1976

[51] Int. Cl.[2] ..... H01J 5/48; H01J 5/50

[52] U.S. Cl. ..... 313/318; 313/326; 339/143 T; 339/144 T

[58] Field of Search ..... 313/325, 326, 318; 339/143 T, 144 T, 182 T

[56] References Cited

U.S. PATENT DOCUMENTS

| | | | |
|---|---|---|---|
| 3,082,350 | 3/1963 | Gulbrandsen | 313/318 |
| 3,867,671 | 2/1975 | Johnson | 313/318 |
| 3,916,238 | 10/1975 | Suzuki | 313/325 |
| 3,979,157 | 9/1976 | DiMattio | 313/318 |

FOREIGN PATENT DOCUMENTS

| | | | |
|---|---|---|---|
| 87,754 | 3/1922 | Germany | 339/143 T |
| 123,327 | 10/1942 | United Kingdom | 339/143 T |

*Primary Examiner*—Saxfield Chatmon, Jr.
*Attorney, Agent, or Firm*—Norman J. O'Malley; William H. McNeill; Robert T. Orner

[57] ABSTRACT

A base for a cathode ray tube includes at least one tube pin isolating means associated therewith to provide arc prevention between adjacent tube pins which can have up to a 12 KV potential difference therebetween.

3 Claims, 7 Drawing Figures

Fig. 4
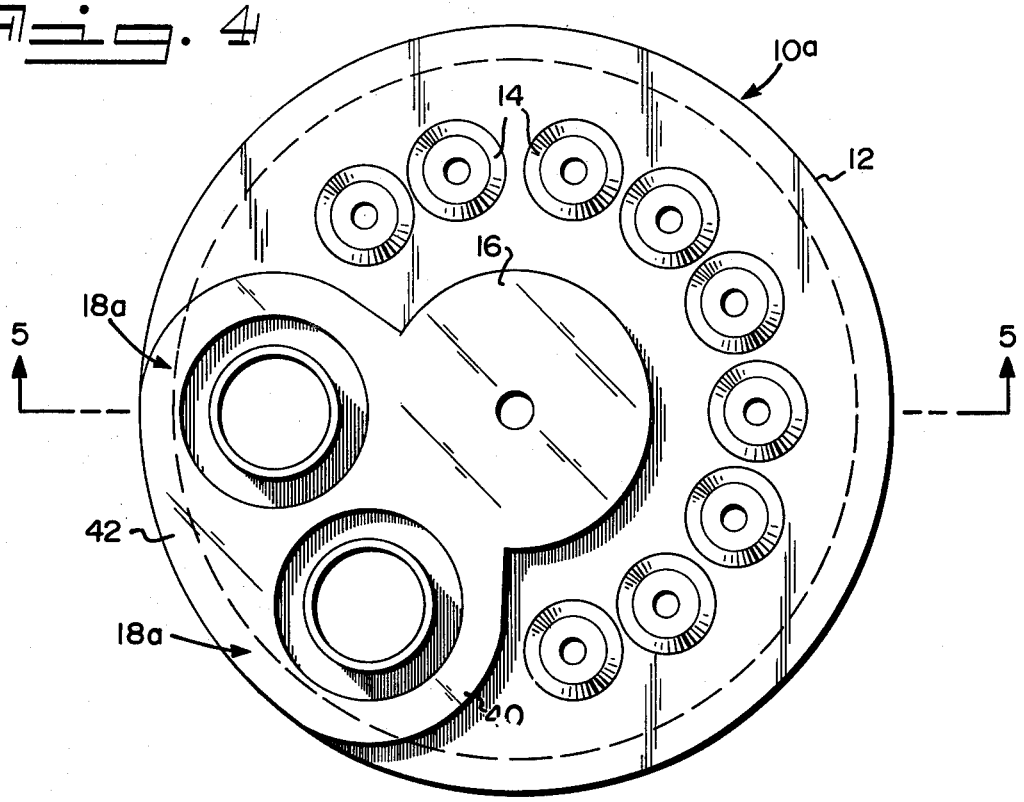
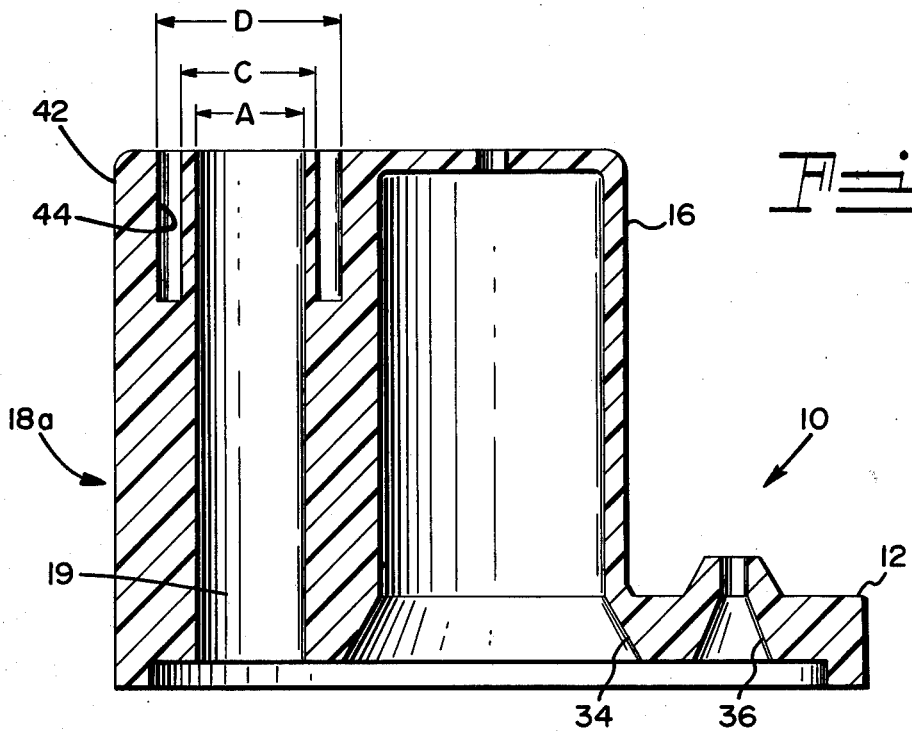
Fig. 5

CATHODE RAY TUBE BASE

BACKGROUND OF THE INVENTION

This invention relates to tube bases and more particularly to tube bases for cathode ray tubes which employ high voltage differentials between various tube pins.

Current and projected types of cathode ray tubes, particularly those employed in color television, have a small diameter neck containing the electron gun or guns. The necessary operating voltages for the various elements of these guns (heaters, cathodes, grids, focusing electrodes, etc.) are supplied via tube pins which are sealed into the end of the tube. As more efficient guns have developed, the neck diameter of the these tubes has gotten smaller, thus dictating that the tube pins, which are annularly arrayed thereabout, keep getting closer together.

Prior art tubes have always had large voltage differentials, sometimes on the order of 5 KV to 8 KV. These high voltage connections have usually had some form of arc protection incorporated into the female socket, see, for example, U.S. Pat. Nos. 3,466,491 and 3,466,492. Such protection, however, has proven incapable of providing adequate protection for the newer tube types.

OBJECTS AND SUMMARY OF THE INVENTION

Accordingly, it is an object of the invention to enhance voltage protection in cathode ray tubes.

It is another object of the invention to prevent or alleviate inter-pin arcing in cathode ray tubes.

Yet another object of the invention is the provision of arcing protection in a tube base.

Still another object of the invention is the provision of a tube base which includes arcing protection which cooperates with a female socket.

Yet another object of the invention is to obviate the disadvantages of the prior art.

These objects are accomplished in one aspect of the invention by a tube base for a cathode ray tube which includes at least one tube pin isolating means associated therewith.

BRIEF DESCRIPTION OF THE DRAWINGS

FIG. 4 is a plan view of a preferred form of the invention;

FIG. 5 is a sectional view taken along the line 5—5 of FIG. 4;

DESCRIPTION OF THE PREFERRED EMBODIMENTS

For a better understanding of the present invention, together with other and further objects, advantages and capabilities thereof, reference is made to the following drawings, and appended claims taken in conjunction with the above-described drawings.

Figure 1:
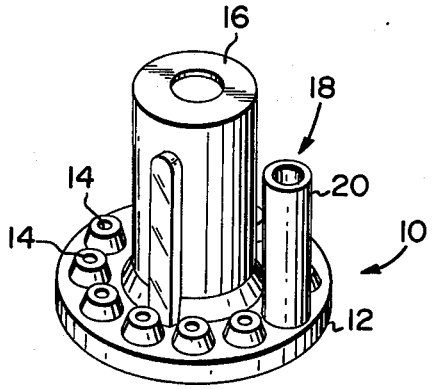
FIG. 1 is a perspective view of a tube base embodying the invention.

Referring now to the drawings with a greater particularity, there is shown in FIG. 1 a base 10 for a cathode ray tube which comprises a substantially flat circular rim 12. A plurality of tube pin receiving apertures 14 extend through the rim 12 and are annularly arrayed and spaced inwardly from the outer circumference of rim 12. A hollow, substantially centrally located crown 16 is positioned on rim 12 and projects therefrom. At least one tube pin isolating means 18 is associated with at least one of the tube pin receiving apertures 14.

Figure 2:
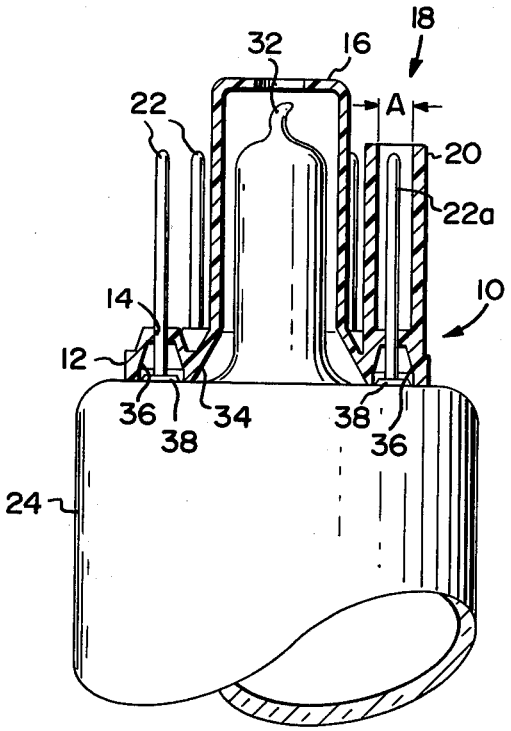
FIG. 2 is an elevational view, partially in section, of a tube base mounted on a cathode ray tube neck.

In the illustrated embodiment shown in FIGS. 1 and 2 the tube pin isolating means 18 is tubular and comprises an elongated, circumferential wall 20 having an internal diameter A which is substantially larger than the diameter of one of the tube pins 22.

FIG. 2 shows base 10 in sealed position on the neck 24 of a cathode ray tube. The tube pins 22 project through the apertures 14 in base 10 and at least on of the pins, *22a*, can be a high voltage lead. Pin *22a* is thus encompassed by the tube pin isolating means 18 which has a length longer than the tube pin.

Figure 3:
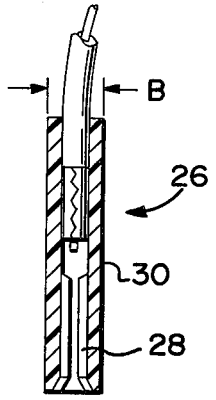
FIG. 3 is a partial sectional view of a lead to be employed with the base FIG. 1.

In FIG. 3 is illustrated a preferred connector 26 for the pin *22a*. Connector 26 comprises a pin clasping end 28 and a cylindrical, electrically insulating portion 30 associated therewith. Portion 30 has an external diameter B which is equal to diameter A and which fits within the tube pin isolating means 20.

The exhaust tubulation 32 projects into crown 16, which has its receiving end tapered, as at 34, to ease insertion. Likewise, the leading edges of apertures 14 are also tapered as at 36 to aid in insertion of pins 22.

The widest part of the taper 36 is sufficiently wide to encompass the glass nubbin 38 which surrounds each tube pin 22. This insures that base 10 fits tightly against the neck 24 and adds further electrical protection.

Figure 6:
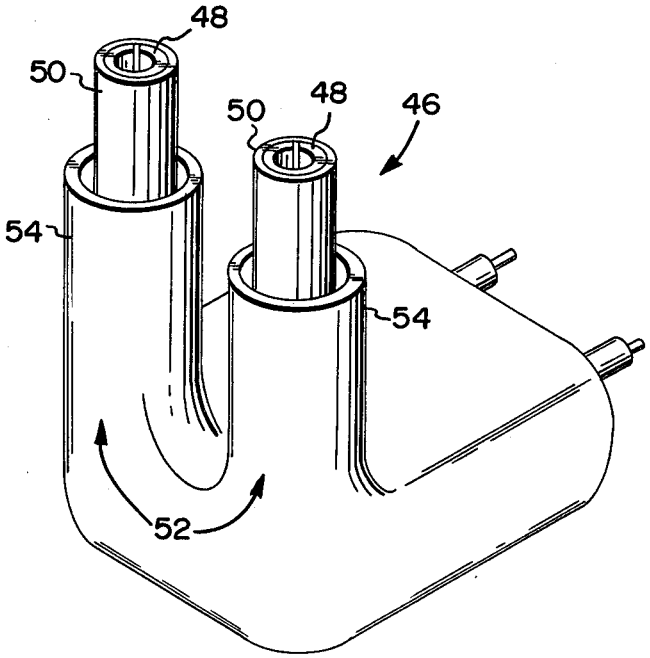
FIG. 6 is a perspective view of a connector that can be employed with the base of FIG. 4.

While the above description generically describes the invention, the presently preferred embodiment is shown in FIGS. 4–6.

Herein, and referring specifically to FIG. 4, the tube pin isolating means *18a* of base *10a* is formed to accept two connectors and thus is formed in association with two tube pin receiving apertures 14. Means *18a* in this instance has a wall 40 which forms an integral extension of the wall of crown 16, thus imparting great strength thereto.

Again, means *18a*, is provided with an aperture 19 having a first diameter A which is substantially larger than the diameter of tube pin *22a* and which aperture 19 extends the full height of the wall 40. The distal end 42 of means *18a*; i.e., the end farthest from the tube neck 24, is provided with a circular slot 44 formed by second and third diameters C and D, which are concentric with first diameter A. The depth of slot 44 is less than the height of wall 40.

A special connector 46 (FIG. 6) is provided for engagement with means *18a* and comprises two separated female contacting portions 48 for engaging tube pins *22a*. Each of the female contacting portions is surrounded by an electrically insulating shaft 50 having an outside diameter B substantially matching the first diameter A of means *18a*. The length of shaft 50 is shorter than the length of the diametered section of wall 40. The distal portion 52 of each shaft 50 is provided with a protruding, circular lip 54 formed for intimate engagement with slot 44.

Figure 7:
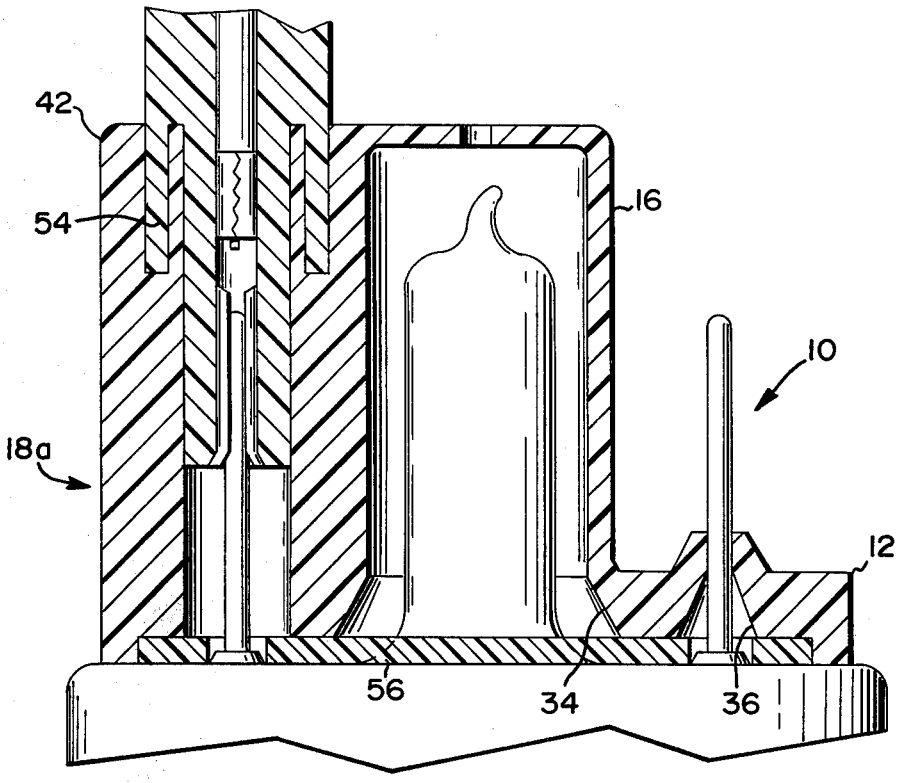
FIG. 7 is a partial sectional of the assembled base of FIG. 5 and connector of FIG. 6.

FIG. 7 illustrates the connector 46 in position with base *10a*. From perusal of FIG. 7 it will be seen that the shaft 50 does not extend to the bottom of aperture 19 but stops short thereof. This construction increases the length of the arcing path along the plastic and greatly reduces the occurrence of arcing.

It is to be noted that there are three prevelant paths for an arc to take: namely, (1) pin to pin thru the air; (2) pin to pin along the glass; and (3) pin to pin along the plastic.

The basic construction of means 18 and 18*a* effectively eliminate (1) above. A rubber washer 56 in the interface between the tube and base effectively eliminates (2) above; and (3) above is effectively eliminated by the lengthened arc path.

It will be seen from the above that the preferred construction provides a base 10*a* having excellent arc resistant qualities.

Arcing can be further obviated by cementing base 10 to neck 24 by means of a rubber or similar electrically insulating cement.

The use of this new and novel base greatly alleviates the problem of inter-pin arcing among tubes whose pins can have, for example, about up to a 12 KV potential difference therebetween.

While there has been shown and described what are at present considered to be the preferred embodiments of the invention, it will be obvious to those skilled in the art that various changes and modifications may be made therein without departing from the scope of the invention as defined by the appended claims.

What is claimed is:

1. A base for a cathode ray tube comprising: a substantially flat, circular rim having a given diameter; a plurality of tube pin receiving apertures extending through said rim, said apertures being spaced inwardly from the outer circumference of said rim and being annularly arrayed; a hollow, substantially centrally located crown positioned on said rim and projecting therefrom adapted to receive the terminus of an exhaust tubulation; and at least one tube pin isolating means associated with at least one of said tube pin receiving apertures; said isolating means comprising an elongated, circumferential wall extending outwardly from said rim and forming an integral extension with the wall of said crown and being substantially the same height as said crown, and further having a first diameter substantially larger than the diameter of said tube pin extending substantially the full height of said wall; and a second diameter and a third diameter concentric with said first diameter forming a circular slot about said first diameter, said slot having a height substantially less than the height of said wall.

2. The base of claim 1 wherein said tube pin isolating means is formed to associate with two of said tube pin receiving apertures.

3. The base of claim 1 wherein said base includes, in combination therewith, a connector having a female contacting portion for engaging a tube pin, said female portion being surrounded by an electrically insulating shaft having an outside diameter substantially matching said first diameter and having a length less than said height of said wall, the distal portion of said insulating shaft being provided with a protruding, circular lip formed for intimate engagement with said slot.

* * * * *